US007896623B2

(12) United States Patent
Hell et al.

(10) Patent No.: US 7,896,623 B2
(45) Date of Patent: Mar. 1, 2011

(54) LINEAR COMPRESSOR WITH SPRING ARRANGEMENT

(75) Inventors: Erich Hell, Giengen (DE); Jan-Grigor Schubert, Senden (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 407 days.

(21) Appl. No.: 11/794,042

(22) PCT Filed: Dec. 2, 2005

(86) PCT No.: PCT/EP2005/056443

§ 371 (c)(1),
(2), (4) Date: Jun. 21, 2007

(87) PCT Pub. No.: WO2006/069890

PCT Pub. Date: Jul. 6, 2006

(65) Prior Publication Data

US 2007/0292286 A1 Dec. 20, 2007

(30) Foreign Application Priority Data

Dec. 23, 2004 (DE) ..... 10 2004 062 298

(51) Int. Cl.
*F04B 35/00* (2006.01)

(52) U.S. Cl. ..... 417/363; 417/417; 248/605

(58) Field of Classification Search ..... 417/415, 417/363, 416, 417; 248/603, 604, 605, 569, 248/570, 581, 587, 602, 610, 611, 628; 267/158, 267/160, 164, 165

See application file for complete search history.

(56) References Cited

U.S. PATENT DOCUMENTS

| | | | | |
|---|---|---|---|---|
| 1,996,160 | A | | 4/1935 | Koenig |
| 2,315,222 | A | | 3/1943 | Lawrence |
| 2,690,529 | A | * | 9/1954 | Lindblad ..... 335/228 |
| 2,907,304 | A | | 10/1959 | Elmer |
| 3,295,808 | A | * | 1/1967 | Webb ..... 248/605 |
| 3,727,865 | A | * | 4/1973 | Melrose et al. ..... 248/632 |
| 4,634,297 | A | | 1/1987 | Schriwer |
| 4,966,789 | A | | 10/1990 | Knapp et al. |
| 4,974,498 | A | | 12/1990 | Lemelson |

(Continued)

FOREIGN PATENT DOCUMENTS

AT 007 706 U 7/2005

(Continued)

OTHER PUBLICATIONS

International Search Report PCT/EP2005/056443.

*Primary Examiner* — Devon C Kramer
*Assistant Examiner* — Nathan Zollinger
(74) *Attorney, Agent, or Firm* — James E. Howard; Andre Pallapies

(57) ABSTRACT

A linear compressor with a pumping chamber, in which a piston moves back and forth, and a frame, fixed to the pumping chamber, on which an oscillating body, connected to the piston, is fixed by at least one spring such as to move back and forth and provided with at least one electromagnet, for driving the back and forth movement of the oscillating body. A one-piece spring connects the oscillating body to the frame and the frame to a fixing body, for fixing the linear compressor to a support.

20 Claims, 2 Drawing Sheets

U.S. PATENT DOCUMENTS

Figure 1:
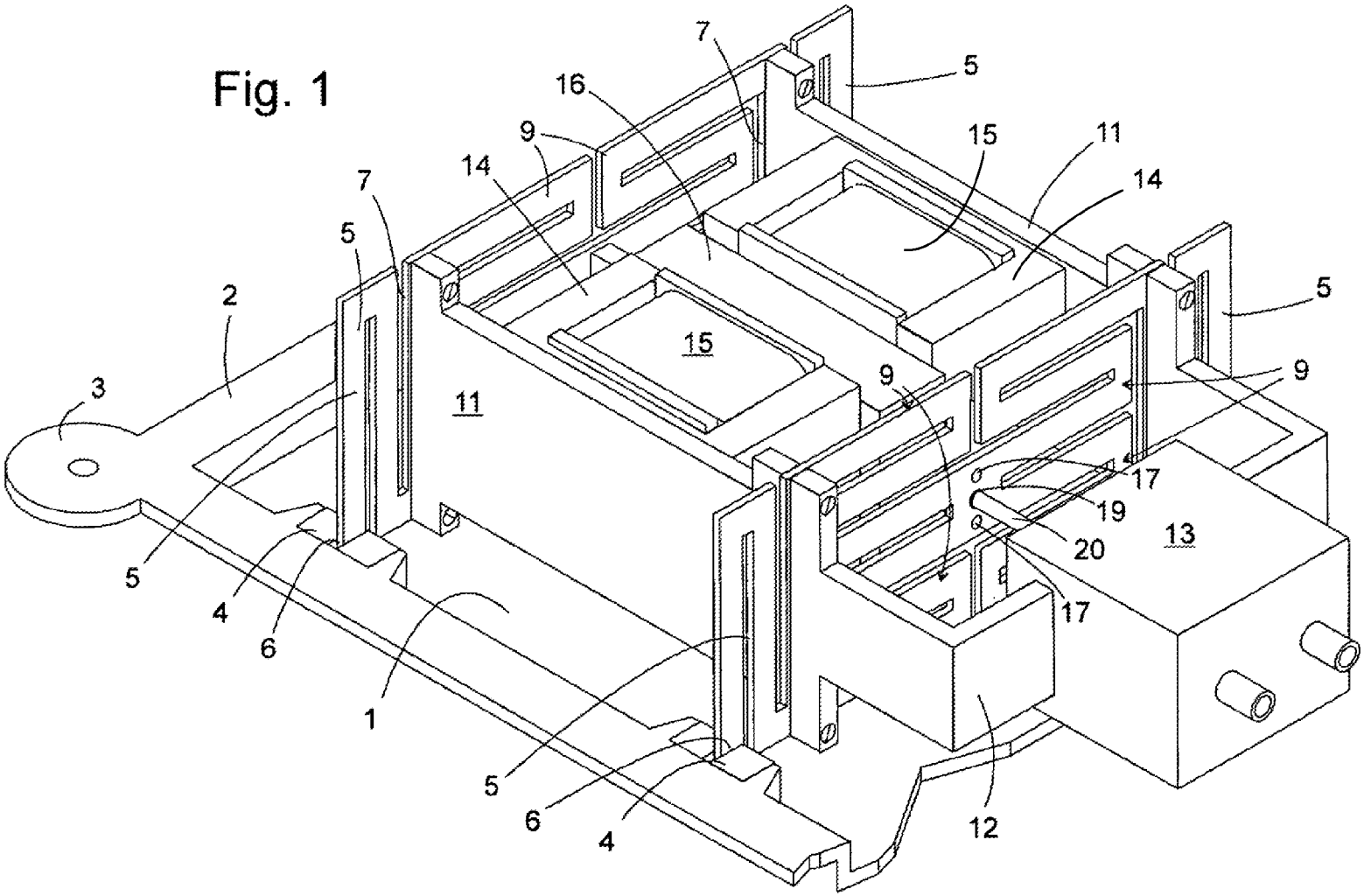

| | | | | |
|---|---|---|---|---|
| 5,139,242 | A * | 8/1992 | Yarr | 267/160 |
| 5,140,905 | A | 8/1992 | Dhar | |
| 5,186,137 | A | 2/1993 | Salzmann | |
| 5,255,521 | A | 10/1993 | Watanabe | |
| 5,293,782 | A * | 3/1994 | Long et al. | 74/25 |
| 5,318,412 | A | 6/1994 | Laskaris et al. | |
| 5,525,845 | A | 6/1996 | Beale et al. | |
| 5,772,410 | A | 6/1998 | Chang | |
| 5,779,455 | A | 7/1998 | Steiger | |
| 6,073,648 | A | 6/2000 | Watson et al. | |
| 6,092,999 | A * | 7/2000 | Lilie et al. | 417/415 |
| 6,405,599 | B1 * | 6/2002 | Patt | 73/779 |
| 6,506,032 | B2 | 1/2003 | Kawahara et al. | |
| 6,641,377 | B2 * | 11/2003 | Toyama et al. | 417/417 |
| 6,742,998 | B2 * | 6/2004 | Kawahara et al. | 417/416 |
| 2002/0155012 | A1 | 10/2002 | Zabar | |
| 2005/0144967 | A1 | 7/2005 | Hebestreit et al. | |
| 2005/0244290 | A1 | 11/2005 | Inagaki et al. | |
| 2006/0083628 | A1 | 4/2006 | Kanai et al. | |
| 2008/0008607 | A1 * | 1/2008 | Schade et al. | 417/410.1 |
| 2008/0019852 | A1 * | 1/2008 | Brand et al. | 417/415 |
| 2008/0089796 | A1 * | 4/2008 | Schade et al. | 417/417 |
| 2009/0129955 | A1 * | 5/2009 | Schubert | 417/417 |

FOREIGN PATENT DOCUMENTS

| | | |
|---|---|---|
| DE | 81 32 123 U | 4/1985 |
| DE | 198 02 453 | 8/1999 |
| EP | 0 864 750 | 9/1998 |
| EP | 0 909 895 | 4/1999 |
| EP | 1 045 145 | 10/2000 |
| EP | 1 126 171 | 8/2001 |
| EP | 1 450 042 | 8/2004 |
| FR | 743 398 | 3/1933 |
| GB | 1 222 425 | 2/1971 |
| JP | 2002-349435 | 12/2002 |
| JP | 2003-49943 | 2/2003 |
| JP | 2004-361039 | 12/2004 |
| WO | WO 89/03480 | 4/1989 |
| WO | WO 00/70223 | 11/2000 |
| WO | WO 03/081041 | 10/2003 |

* cited by examiner

LINEAR COMPRESSOR WITH SPRING ARRANGEMENT

This invention relates to a linear compressor, in particular a linear compressor which is suitable for compressing refrigerant in a refrigerating device.

U.S. Pat. No. 6,641,377 B2 discloses a linear compressor with a pumping chamber in which a piston moves back and forth, a frame which is fixedly connected to the pumping chamber and on which an oscillating body, connected to the piston, is fixed by at least one spring such as to move back and forth, and with at least one electromagnet mounted on the frame for driving the back and forth movement of the oscillating body.

The oscillating force exerted by the magnet on the oscillating body generates a corresponding oscillating counter-force which the frame exerts on a support to which it is fastened. If it is not compensated for, this oscillating counter-force may excite the support or other parts connected to it to generate oscillations which are perceived by a user as operating noise.

In order to minimise such oscillations two pistons interact in the linear compressor of prior art, which pistons penetrate the pumping chamber from two different sides. If these pistons have equal masses and are retained by springs of the same strength, it is possible to actuate the driving electromagnet of each piston so that the pistons oscillate in exactly the opposite phases so that the counter-forces caused by the oscillating movement and acting on the frame are mutually compensating.

Such a linear compressor is expensive because the pistons and the driving means assigned to them must always be provided in pairs. However, it is also difficult to guarantee an exactly mirror-symmetrical movement of the two pistons because variation of the oscillating masses due to production conditions, and particularly of the stiffness of the springs retaining them, lead to different natural frequencies of the two pistons. Different amplitudes and phases of the piston movement may result from this if the magnets are excited on both sides with the same alternating current.

Although it is also possible to realise a linear compressor with a single oscillatory piston in which the transmission of counter-forces acting on a frame to a support of the compressor is limited due to the fact that the frame is in turn suspended so that it can oscillate relative to the support, a large number of springs are required for such a linear compressor, thus rendering assembly of the linear compressor time-consuming and expensive.

The object of this invention is to provide a linear compressor which prevents, by simple means, excessive transmission of oscillations to a support to which the linear compressor is fastened.

The object is achieved in that an integral spring connects the oscillating body to the frame on the one hand, and connects the frame to a fastening body on the other, which body serves to fasten the linear compressor to an external support. Thus only a single spring is required to ensure the oscillating capacity of the oscillating body and the piston connected to it relative to the frame and pumping chamber, respectively, and that of the frame and pumping chamber relative to the outer support. A small number of parts is therefore sufficient to protect the support effectively from the oscillations of the linear compressor. This saves on the costs of parts and production.

In order to limit the transmissions of oscillations not only as structural noise but also via the air, the fastening body is preferably designed as a housing surrounding the pumping chamber and frame.

A diaphragm spring is ideally suited for securing to the housing the oscillating body, the frame and the fastening body so that they are mutually oscillating.

To achieve a long stroke when the dimensions of the diaphragm spring are small, it comprises preferably at least one curved spring limb. A spring limb curved in zigzag fashion is particularly preferred because it in any cases generates low torques between mutually oscillating parts.

In order to minimise torques associated with the oscillation, particularly between the frame and the oscillating body, it is also appropriate for the diaphragm spring to comprise at least two curved limbs connecting the frame to the oscillating body, limbs which are mirror symmetrical to each other relative to a plane parallel to the direction of movement of the oscillating body. The torques generated by such limbs act in opposite directions so that they are mutually compensating.

A stable suspension, using a minimum number of components, may be achieved if the spring is connected in a central section to the oscillating body, in two end sections to the fastening body and on sections lying between the central section and the end sections, to the frame.

For a further reduction in the transmission of oscillations to the support, the spring may be connected to the fastening body by means of an oscillation-damping element.

To guarantee exact linear guidance of the oscillating body, the linear compressor is preferably equipped with a second, integral spring connecting the oscillating body to the frame and the frame to the fastening body, the springs engaging on the oscillating body and spaced in the direction of the back and forth movement.

At least one pair of magnets, arranged in an anti-parallel manner and with a field axis orientated toward the direction of movement of the oscillating body on opposite sides of the oscillating body, serve to drive the oscillating movement.

Figure 2:
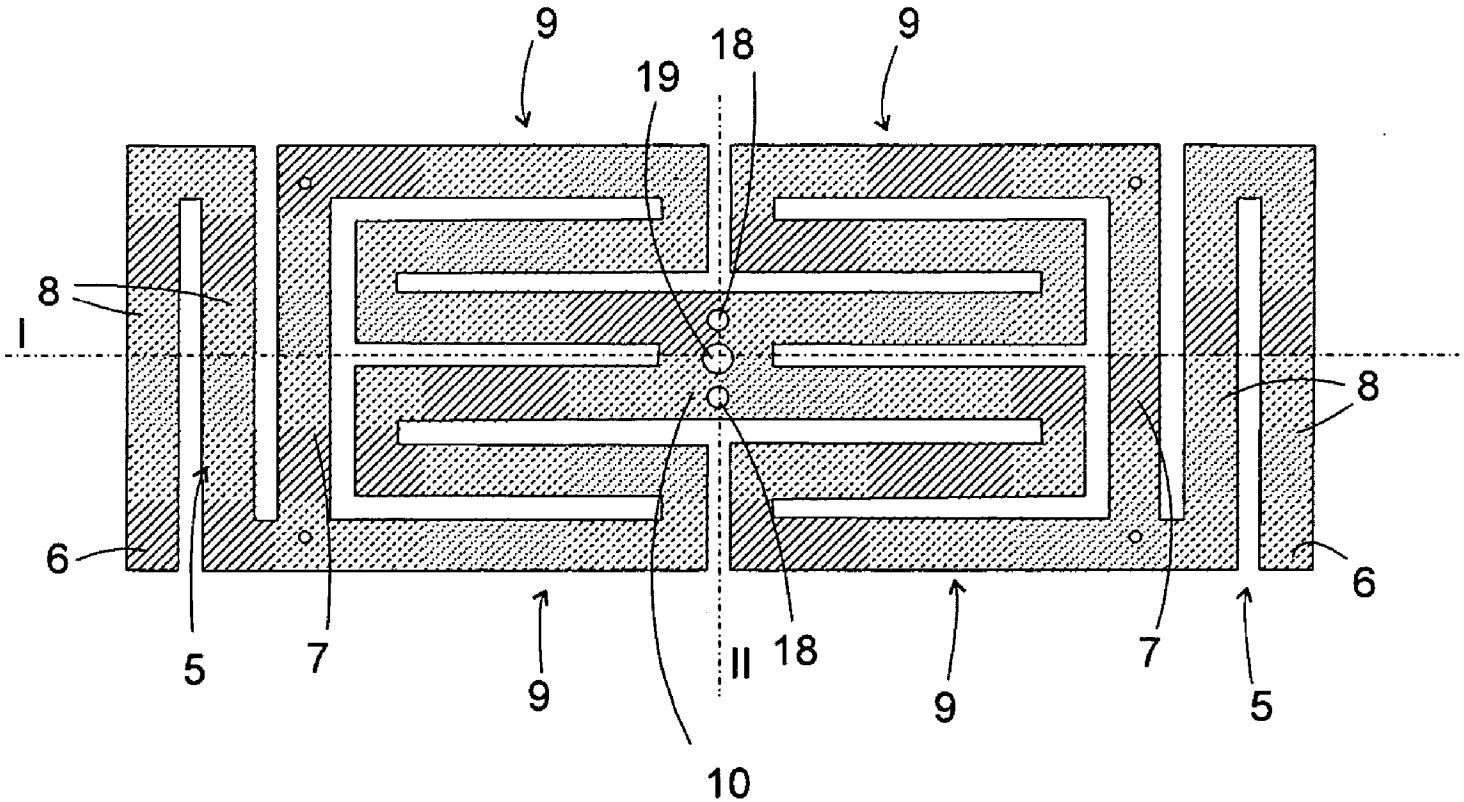

Further features and advantages of the invention are apparent from the following description of an exemplary embodiment with reference to the attached figures, where:

FIG. 1 shows a perspective view of a linear compressor according to the invention; and FIG. 2 shows an elevation of a diaphragm spring of the linear compressor in FIG. 1.

The linear compressor shown in FIG. 1 comprises a sound-insulating housing, only one of two shells 1 of which is partially shown in the figure. The shells touch each other on a peripheral flange 2, thus forming an envelope that is closed, except for openings for a refrigerant suction pipe or pressure pipe, not shown. Several lugs 3 are formed on flange 2 for fastening the shells to each other and to a support which is not shown in the figure and is not regarded as part of the compressor.

Four supports for buffers 4 of rubber, elastic foam or other oscillation-absorbent material are formed on the inner wall of shell 1, only two of which supports, which bear against an edge of shell 1 facing towards the observer, are visible. Buffers 4 each have a slot which receives an end section 6 of a spring limb 5. Spring limbs 5 are each part of a diaphragm spring punched integrally from spring steel, which spring is shown in FIG. 2 in an elevation.

The diaphragm spring has two spring limbs 5, each of which depart from an elongated intermediate section 7 and comprise two rectilinear sections 8 parallel to intermediate section 7. Further spring limbs 9 extend from opposite longitudinal ends of the two intermediate sections 7 in zigzag fashion to a central section 10 of the spring, on which all four spring limbs 9 converge. Spring limbs 9 each have three rectilinear sections. Each spring limb 9 is the mirror image of the two spring limbs adjacent to it, related to planes of symmetry represented by dash-dot lines I and II in FIG. 2 and running parallel to the direction of oscillation.

Bores at the longitudinal ends of intermediate sections 7 serve to fasten a frame, which consists of three elements, two wall sections 11, which extend between intermediate sections 7 of the two diaphragm springs facing each other, and an arc 12 which curved beyond spring limbs 9 of the front diaphragm spring and supports a pumping chamber 13.

Wall sections 11 each support, on their sides facing each other, a soft iron core 14 with three interconnected, parallel legs, the central leg of which is concealed in the figure by a magnetic coil 15, through whose winding it extends.

In a gap between the free ends of soft iron cores 14 facing each other is suspended an oscillating body 16. A permanently magnetic central piece of oscillating body 16 substantially fills the gap between soft iron cores 14. Tapered end sections of oscillating body 16 are each retained on the diaphragm springs by means of screws or rivets 17, which extend through bores 18 in central section 10 of the diaphragm springs. A piston rod 20, which connects oscillating body 16 rigidly to a piston, not shown, moving back and forth in pumping chamber 13, extends through a larger, central bore 19 in the diaphragm spring facing the observer in the figure.

The central section of oscillating body 16 is a permanent bar magnet whose field axis coincides with the longitudinal axis of piston rod 20 and whose poles project in the direction of oscillation from the gap between soft iron cores 14 in the position of equilibrium shown in FIG. 1. Magnet coils 15 are connected so that their fields each have similar poles facing each other. By exciting magnetic coils 15 with an alternating current the north pole or south pole of the permanent magnet are alternately drawn into the centre of the gap and oscillating body 16 is therefore excited into oscillation.

Oscillating body 16 is easily displaceable in the direction of piston rod 20 due to the suspension of oscillating body 16 by means of four spring limbs 9 at both its longitudinal ends; in a direction perpendicular to this direction the stiffness of spring limbs 9 is considerably greater, so that oscillating body 16 and with it the piston are reliably guided in the direction of oscillation.

The invention claimed is:

1. A linear compressor in an assembled state comprising:
a pumping chamber;
a piston being movable back and forth;
a frame fixedly connected to the pumping chamber;
a one-piece spring;
an oscillating body connected to the piston being retained on the frame by at least one first spring limb of the spring so that the oscillating body can move back and forth; and
at least one electromagnet being mounted for driving the back and forth movement of the oscillating body,
wherein the spring movably connects the oscillating body to the frame, and
the spring movably connects the frame to a fastening body for fastening the linear compressor to a support such that elastic movement of the spring allows the frame to move relative to the fastening body.

2. The linear compressor according to claim 1, wherein the fastening body includes a housing surrounding the pumping chamber and the frame.

3. The linear compressor according to claim 1, wherein the spring includes a diaphragm spring.

4. The linear compressor according to claim 1, wherein the first spring limb is curved in zigzag fashion.

5. The linear compressor according to claim 3, wherein the first spring limb is curved in a zigzag fashion, and
the diaphragm spring comprises at least two of the first spring limbs that connect the frame to the oscillating body, the first spring limbs being mirrored symmetrically to each other with respect to a plane that lies parallel to the direction of movement of the oscillating body.

6. The linear compressor according to claim 1, wherein the spring is connected in a central section to the oscillating body, in two end sections to the fastening body and on sections lying between the central section and the end sections to the frame.

7. The linear compressor according to claim 1, wherein the spring is connected to the fastening body by means of at least one oscillation damping element.

8. The linear compressor according to claim 1, further comprising a second one-piece spring connecting the oscillating body to the frame and connecting the frame to the fastening body, and in that the springs engage on the oscillating body, the springs being spaced in the direction of the back and forth movement.

9. The linear compressor according to claim 1, further comprising at least one pair of electromagnets arranged on opposite sides of the oscillating body and arranged anti-parallel to, and having a field axis orientated transversely to, the direction of movement of the oscillating body.

10. The linear compressor according to claim 3, wherein the diaphragm spring comprises at least one second spring limb being curved in a zigzag fashion, the second spring limb connecting the frame to the fastening body.

11. A linear compressor, comprising:
a fastening body;
a frame;
a pumping chamber rigidly fixed to the frame;
a piston movable back and forth relative to the pumping chamber;
an oscillating body connected to the piston such that it moves back and forth with the piston;
an electromagnet attached to the frame and driving the back and forth movement of the oscillating body;
a one-piece spring fixed to the oscillating body at a first connection point of the spring, fixed to the frame at a second connection point of the spring, and fixed to the fastening body at a third connection point of the spring,
wherein the spring allows the oscillating body to move relative to the frame, and
movement of the third connection point relative to the second connection point allows the frame to move relative to the fastening body.

12. The linear compressor according to claim 11, wherein the spring is a flat plate having a plurality of limbs.

13. The linear compressor according to claim 12, wherein the oscillating body is attached to the frame by a first limb of the spring.

14. The linear compressor according to claim 13, wherein the frame is attached to the fastening body by a second limb of the spring.

15. The linear compressor according to claim 14, wherein the spring has a first pair of the first limbs, the first pair of the first limbs being mirror images of each other relative to a first plane that lies parallel to the direction of the back and forth movement of the oscillating body.

16. The linear compressor according to claim 15, wherein the spring has a second pair of the first limbs, the second pair of the first limbs being mirror images of each other relative to a second plane that lies parallel to the direction of the back and forth movement of the oscillating body, the second plane being perpendicular to the first plane.

17. The linear compressor according to claim 16, wherein the spring has two of the second limbs, each of the second limbs attaching the frame to the fastening body on an opposite side of the frame.

18. The linear compressor according to claim 16, wherein each of the first limbs has an "S" shape, with one end of the "S" being fixed to the frame and the other end of the "S" being fixed to the oscillating body.

19. The linear compressor according to claim 15, wherein each of the first limbs has an "S" shape, with one end of the "S" being fixed to the frame and the other end of the "S" being fixed to the oscillating body.

20. The linear compressor according to claim 19, further comprising two of the one-piece spring.

* * * * *